US006101353A

United States Patent [19]

Yu et al.

[11] Patent Number: 6,101,353

[45] Date of Patent: Aug. 8, 2000

[54] FLEXIBLE PHOTORECEPTOR BELT DETENSIONING FOR CHARGE TRANSPORT LAYER CRACKING LIFE EXTENSION

[75] Inventors: Robert C. U. Yu; Satchidanand Mishra, both of Webster, N.Y.

[73] Assignee: Xerox Corporation, Stamford, Conn.

[21] Appl. No.: 09/340,561

[22] Filed: Jun. 28, 1999

Related U.S. Application Data

[60] Provisional application No. 60/113,021, Dec. 21, 1998.

[51] Int. Cl.[7] ..... G03G 21/00

[52] U.S. Cl. ..... 399/165; 399/162

[58] Field of Search ..... 399/162, 165, 399/159, 116; 250/590

[56] References Cited

U.S. PATENT DOCUMENTS

| | | | |
|---|---|---|---|
| 4,626,095 | 12/1986 | Berger | 399/165 |
| 5,065,022 | 11/1991 | Horikawa | 250/590 |
| 5,243,384 | 9/1993 | Everdyke et al. | 399/116 |
| 5,541,709 | 7/1996 | Wilcox | 399/116 |
| 5,604,570 | 2/1997 | Jeran et al. | 399/116 |
| 5,708,924 | 1/1998 | Shogren et al. | 399/116 |

*Primary Examiner*—Susan S. Y. Lee

*Attorney, Agent, or Firm*—William A. Henry II; Zosan S. Soong

[57] ABSTRACT

A system for increasing the life of flexible photoreceptor belt in a copier/printer includes tensioning and de-tensioning the photoreceptor belt. The photoreceptor belt is de-tensioned at the end of daily use, on weekends, and on non working days in order to reduce belt dimensional elongation due to creep which thereby suppresses the development of charge transport layer cracking in the photoreceptor belt and increases belt service life of the photoreceptor by a factor of about 2×.

12 Claims, 4 Drawing Sheets

FLEXIBLE PHOTORECEPTOR BELT DETENSIONING FOR CHARGE TRANSPORT LAYER CRACKING LIFE EXTENSION

Priority is claimed from a U.S. provisional application No. 60/113021 filed Dec. 21, 1998 by the same inventors and assignee.

BACKGROUND OF THE INVENTION

The present invention relates generally to an electrostatographic printing machine, and more particularly, concerns improving a photoreceptor life within such a machine employing the photoreceptor in flexible belt configuration.

Flexible electrostatographic imaging members are well known in the art. Typical electrostatographic imaging members include, for example, photoreceptors for electrophotographic imaging systems and electroreceptor such as ionographic imaging members for electrographic imaging systems. These imaging members generally comprise at least a supporting substrate layer and at least one imaging layer comprising thermoplastic polymer matrix material. The "imaging layer" as employed herein is defined as the dielectric imaging layer of an electroreceptor or the photoconductive imaging layer of a photoreceptor. In a photoreceptor, the photoconductive imaging layer may comprise only a single photoconductive layer or a plurality of layers such as a combination of a charge-generating layer and a charge transport layer.

Although the discussions hereinafter focus only on flexible electrophotographic imaging member belts, nonetheless the problems encountered therewith are equally applicable to flexible electrographic imaging member belts and all types of flexible belts as well.

Generally, in the art of electrophotography, the process of electrophotographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member surface such that the developing material is attracted to the charged image areas on the photoconductive surface. Thereafter, the developing material is transferred from the photoreceptive member to a receiving copy sheet or to some other image support substrate, to create an image, which may be permanently affixed to the image support substrate, thereby providing an electrophotographic reproduction of the original document. In a final step in the process, the photoconductive surface of the photoreceptive member is cleaned with a cleaning device, such as elastomeric cleaning blade, to remove any residual developing material, which may be remaining on the surface thereof in preparation for successive imaging cycles.

The electrostatographic copying process described hereinabove, for electrophotographic imaging, is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images. One of the drawbacks to the above-described process utilizing a flexible imaging member belt is that the belt, photoreceptor belt in particular, often time does not last to a desired target number of printing cycles. This is due to the machine belt module design employing a number of backer bars and small diameter belt support rollers to support the photoreceptor belt for movement during electrophotographic image processing cycles. These backer bars and small diameter belt support rollers cause substantial belt fatigue through bending stress/strain build-up in the charge transport layer, promoting the onset development of premature charge transport layer cracking as a result of repetitions of the photoreceptor belt flexing over the small diameter belt support rollers and backer bars during machine cyclic photoreceptor belt function. Charge transport layer cracking is considered as a major mechanical failure since the cracks manifest themselves into copy print out defects.

Under a machine service condition, the flexible photoreceptor belt mounted over the belt support module is constantly subjected to a specific applied belt tension. Since the photoreceptor belt consists of layers of thermoplastic materials, it will, in addition to the above-described bending strain, also exhibit a time dependent creep compliance dimensional elongation in response to the constant applied belt tension. The compounding result of creep compliance belt elongation to the bending induced strain has been found to exacerbate the early onset of charge transport layer cracking and further shortening the functional life of the photoreceptor belt.

PRIOR ART

The following disclosure may be relevant to certain aspects of the present invention:

U.S. Pat. No. : 5,708,924

Patentee: Daniel K. Shogren et al.

Issued: Jan. 13, 1998

U.S. Pat. No. 5,708,924 is directed to a customer replaceable unit that includes a comer and support structure for supporting a photoreceptor belt while it is packaged, shipped and inserted over drive and idler rolls in a machine. It prevents a machine operator from having to handle the belt itself and provides protection from extrinsic damage. A machine is described that includes backer bars for tensioning the photoreceptor belt during use.

SUMMARY OF THE INVENTION

Accordingly, pursuant to the features of the present invention, a method and apparatus is disclosed that extends the service life of a flexible photoreceptor belt that includes de-tensioning the photoreceptor belt during period of machine idle, shut-off at the end of each day and on weekends or other non-work days to effectively suppress and minimize the component of photoreceptor belt strain contributed by belt elongation caused by the applied belt tension creep compliance. This reduction in photoreceptor belt strain shall therefore prevent the early onset of charge transport layer fatigue cracking and add functional life to the belt.

BRIEF DESCRIPTION OF THE DRAWINGS

The foregoing and other features of the instant invention will be apparent and easily understood from a further reading of the specification, claims and by reference to the accompanying drawings in which:

Figure 1:
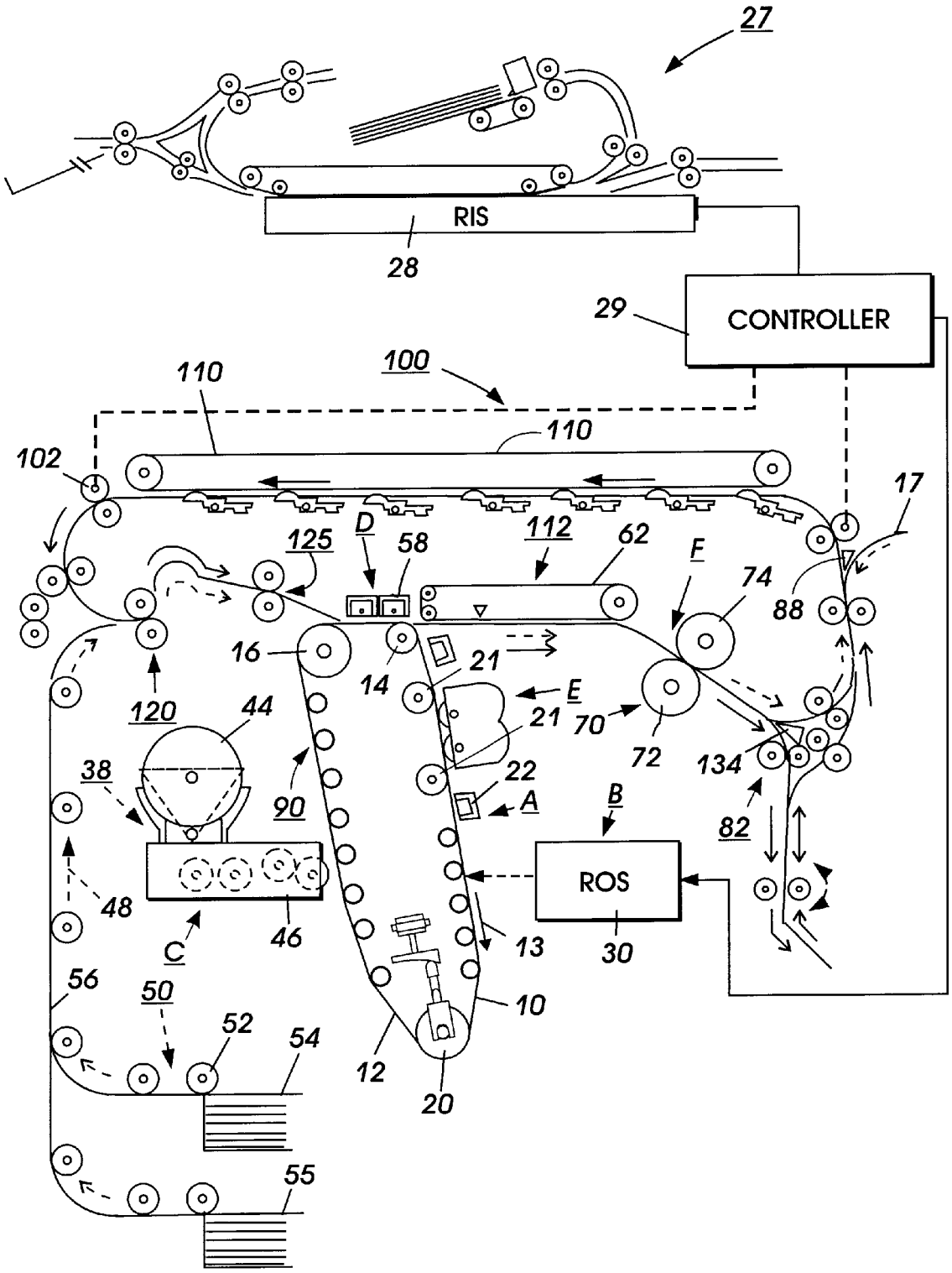
FIG. 1 is a schematic elevational view depicting the belt tensioning and de-tensioning scheme of the present invention in a printing machine.

All references cited in this specification, and their references, are incorporated by reference herein where appropriate for teaching additional or alternative details, features, and/or technical background.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

DETAILED DESCRIPTION OF THE INVENTION

For a general understanding of the features of the present invention, reference is made to the drawings. In the drawings, like reference numerals have been used through out to identify identical elements.

FIG. 1 schematically illustrates an electrophotographic printing machine which generally employs a flexible photoconductive belt 10 mounted on a belt support module 90. Preferably, the photoconductive belt 10 is made from a photoconductive material coated on a ground layer over a support substrate, which back side, in turn, is coated onto with an anti-curl backing layer to render photoreceptor belt flatness. Belt 10 moves in the direction of arrow 13 to advance successive portions sequentially through the various processing stations disposed about the path of movement thereof. Belt 10 is entrained about stripping roll 14, drive roll 16, idler roll 21, and tensioning roll 20. As drive roll 16 rotates, it advances belt 10 in the direction of arrow 13.

Initially, a portion of the photoconductive belt surface passes through charging station A. At charging station A, a corona generating device indicated generally by the reference numeral 22 charges the surface of photoconductive belt 10 to a relatively high, substantially uniform potential.

At an exposure station B, a document handler, indicated generally by reference numeral 27 feeds documents to a raster input scanner (RIS) 28 where the documents are converted into image signals, a controller or electronic subsystem (ESS), indicated generally by reference numeral 29, receives the image signals from RIS 28 representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated microcomputer. The image signals transmitted to ESS 29 may originate from RIS 28 as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably a nine-facet polygon is used. The ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tome image received from ESS 29. As an alternative, ROS 30 may employ a linear array of light emitting diodes (LEDs) arranged to illuminate the charged portion on the surface of photoconductive belt 10 on a raster-by-raster basis.

After the electrostatic latent image has been recorded on photoconductive surface 12, belt 10 advances the latent image to a development station C, where toner, in the form of liquid suspension or dry particles, is electrostatically attracted to the latent image using commonly known techniques. For dry development system, the latent image attracts toner particles from the carrier granules forming a dry toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station D, by a sheet feeding apparatus 50. Preferably, sheet feeding apparatus 50 includes a feed roll 52 contacting the uppermost sheet of stack 54. Feed roll 52 rotates to advance the uppermost sheet from stack 54 to vertical transport 56. Vertical transport 56 directs the advancing sheet 48 of support material into registration nip 120 which forwards the sheet into buckle nip 125. Buckle nip 125 then drives the sheet past image transfer station D to receive an image from photoreceptor belt 10 in a timed sequence so that the toner powder image formed thereon contacts the advancing sheet 48 at transfer station D. Transfer station D includes a corona-generating device 58, which sprays ions onto the backside of sheet 48. This attracts the toner powder image from photoconductive surface 12 to sheet 48. After transfer, sheet 48 continues to move by way of belt transport 112 and belt 62, which advances sheet 48 to fusing station F.

Fusing station F includes a fuser assembly indicated generally by the reference numeral 70 which permanently affixes the transferred toner power image to the copy sheet. Preferably, fuser assembly 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 134 either allows the sheet to move directly via output 17 to a finisher or stacker, or deflects the sheet into the duplex path 100, specifically, first into single sheet inverter 82 here. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransfered toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Controller 29 regulates the various machine functions. The controller is preferably a programmable microprocessor, which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
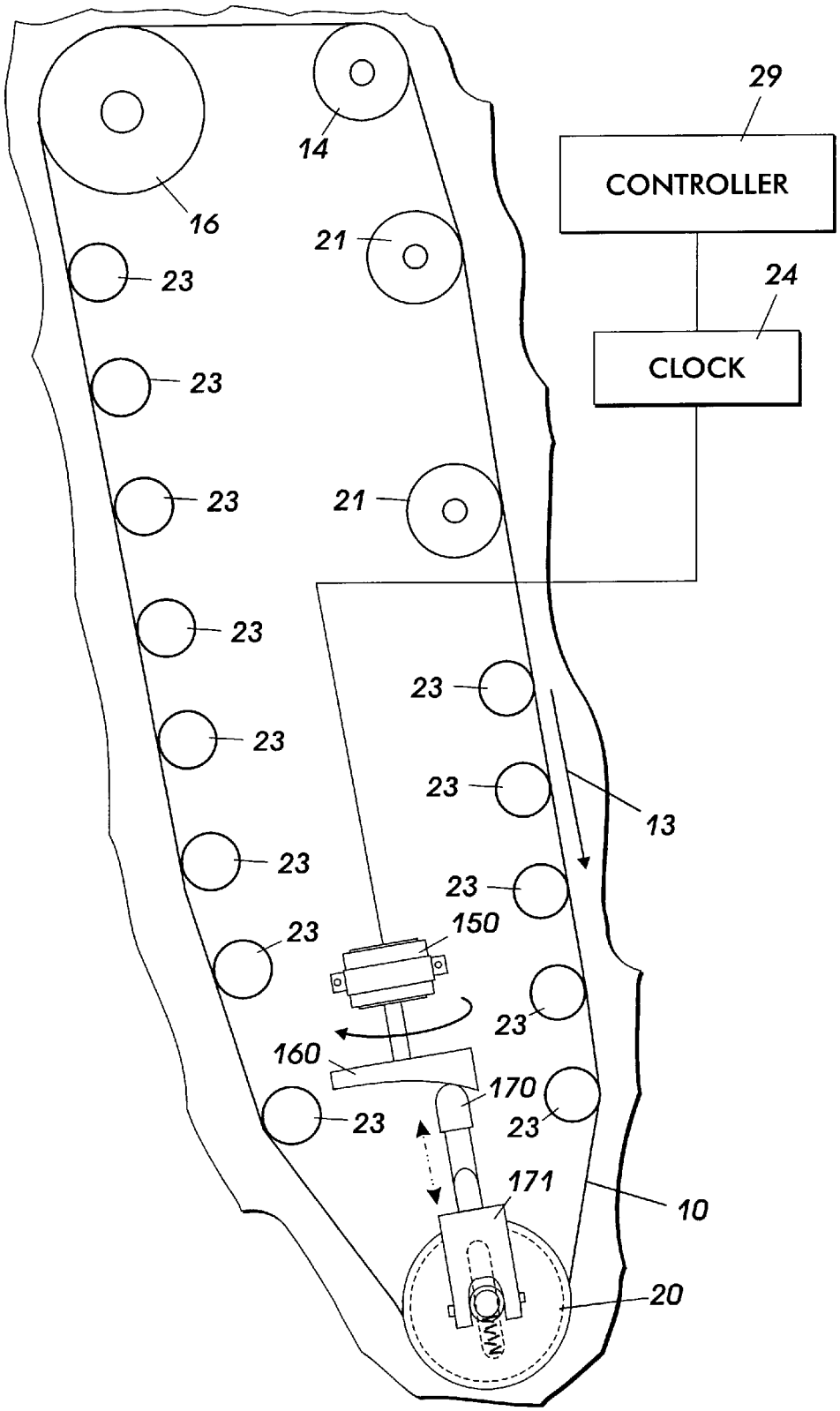
FIG. 2 illustrates a photoreceptor belt in an expanded, tensioned, run position.
Figure 3A:
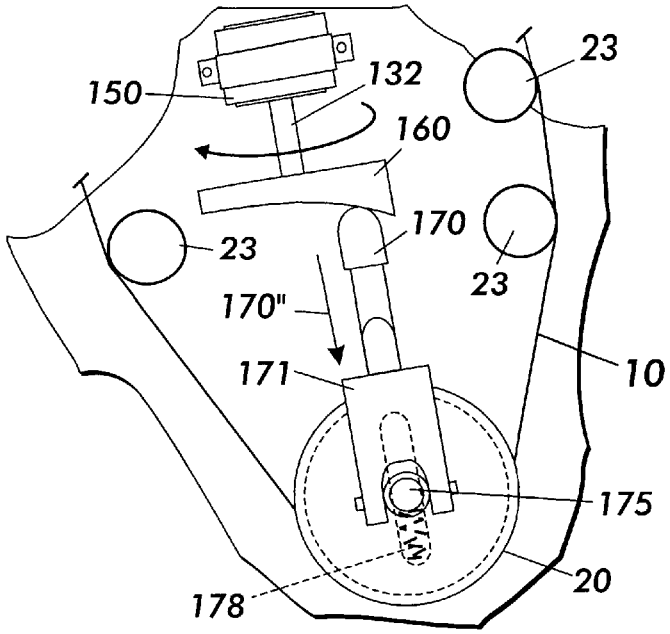
FIG. 3A is an expanded, partial illustration of the photoreceptor belt of FIG. 2 in its run position.
Figure 3B:
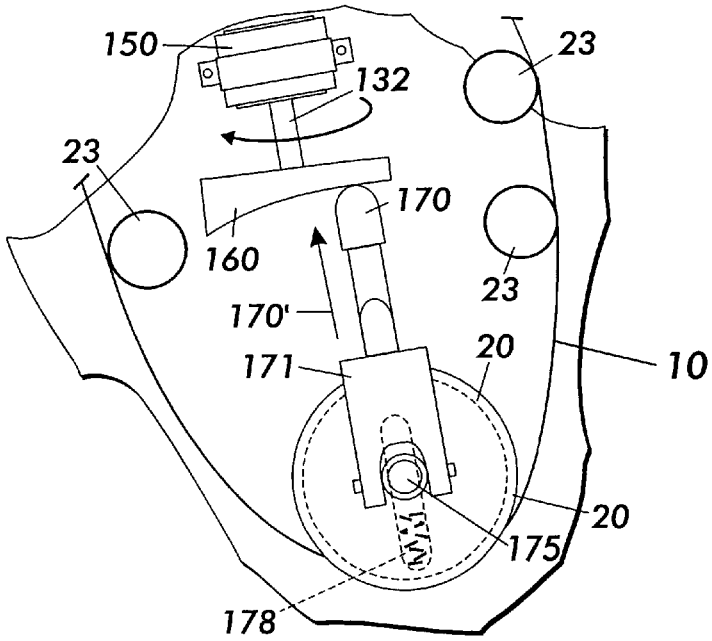
FIG. 3B is an expanded, partial illustration of the photoreceptor in FIG. 2 in a belt de-tensioned, idle position.

Referring now to the subject matter of the present invention, FIG. 2 depicts the photoreceptor belt 10 in a tensioned image receiving position as it is entrained around drive roll 16, tensioning roll 20, idler rolls 21, and stripping roll 14. Various sized backer bars 23 are stationary and serve to position and guide belt 10. A controller 29 through clock 24 controls the actuation of stepper motor 150 in order to precisely tension photoreceptor belt 10 into a run or image receiving position. The controller 29 when prompted by an operator requiring copies to be made will move the printer of FIG. 1 from a power saver mode with photoreceptor belt 10 now in the de-tensioned position as shown in FIG. 3B to a run mode with photoreceptor belt 10 in the position as shown in FIG. 3A, by signaling clock 24 to actuate stepper motor 150. Stepper motor 150 in turn rotates attached cam 160 in a clockwise direction. Rotation of cam 160 in the clockwise direction causes the cam to press against movable plunger 170 that is mounted within housing 171 and supported on shaft 175 and move the plunger in a downward direction of arrow 170". Shaft 175 is continually biased by spring 178 in the direction of arrow 170' as shown in FIG. 3B. This entrainment of photoreceptor belt 10 around the small belt support rolls and the use of a series of small radius backer bars 23 to guide the belt are instrumental in causing early development of fatigue charge transport layer cracking.

Experiments have shown that a seven pitch mutilayered, flexible photoreceptor belt functioned in the belt module configuration as shown in FIGS. 1 and 2, having 5 belt support rollers and 13 non-rotating backer bars and under an applied belt tension of 1.1 lbs/inch, has a fatigue charge transport layer cracking life of about 91.6 K photoreceptor belt rotational cycles. In accordance with the present invention, de-tensioning a photoreceptor belt during shut off or when the machine is in a standby mode, the service life of this photoreceptor belt having the same material composition as the experimentally tested one can be substantially extended, due to the effectual prolonging of the on-set of fatigue charge transport layer cracking. For example, using a nine hour workday, 5 working days per week, and a de-tensioning of from 1.1 lbs/inch to a low of 0.28 lbs/inch applied belt tension during machine off time conditions, the above photoreceptor belt's charge transport layer cracking life is, based from theoretical prediction, about 203.4 K belt cycles since the cumulative charge transport layer strain is reduced as a result of photoreceptor belt creep compliance suppression by adapting the belt de-tensioning strategy during machine off time. This result represents a photoreceptor belt service life improvement of more than 2.3×.

The step of de-tensioning the photoreceptor belt 10 is illustrated in FIGS. 3A and 3B. It comprises stepper motor 150 rotating shaft 132 in a clockwise direction, as shown in FIG. 3A, to thereby remove the thick portion of cam 160 attached thereto away from plunger 170. Spring 178 will then push plunger 170 upward, as shown by the arrow direction of 170' in FIG. 3B, thus de-tensioning the belt to a predetermined amount.

Figure 4:
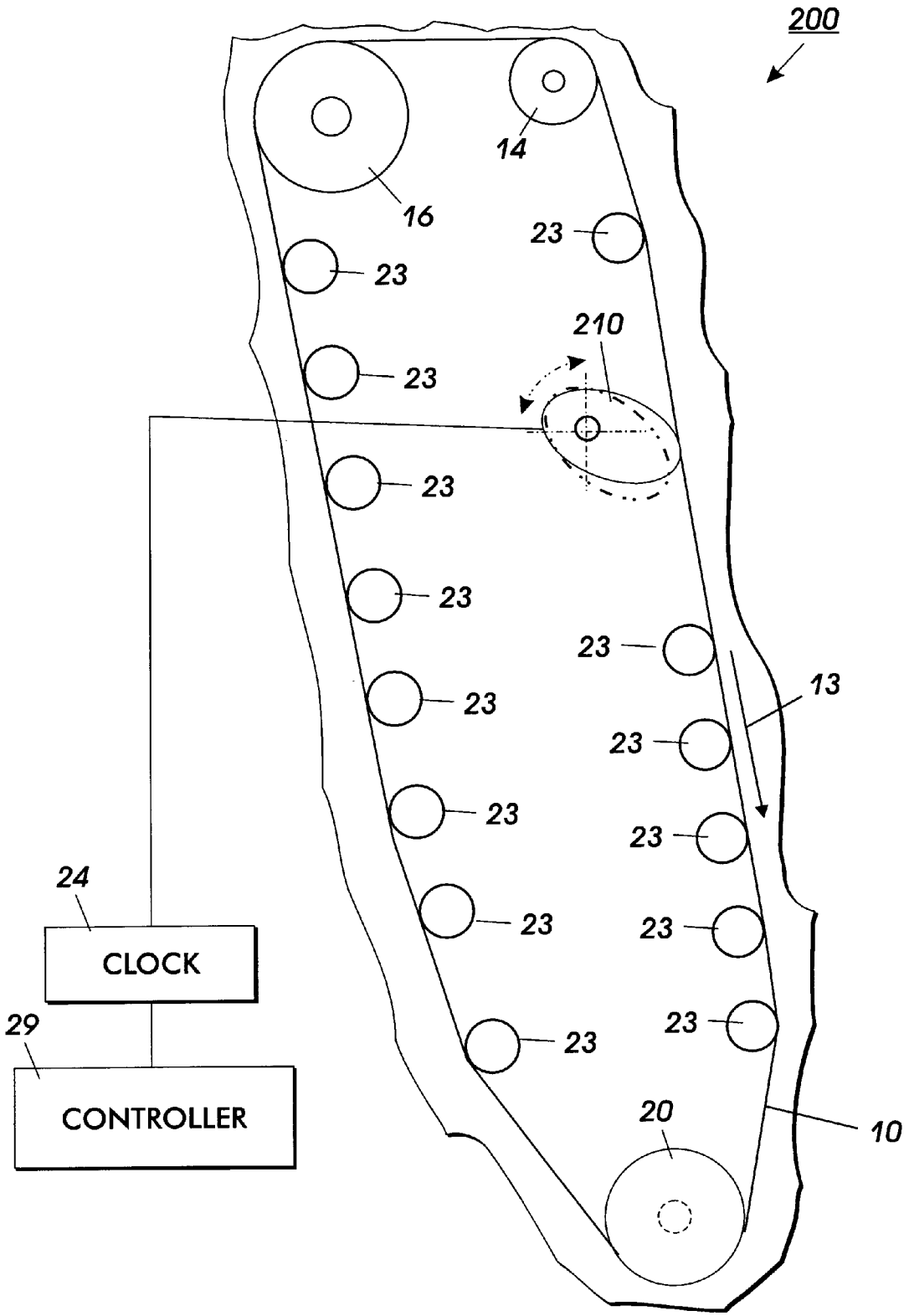
FIG. 4 illustrates a photoreceptor belt in an expanded, tensioned, run position employing an alternative belt tensioning and de-tensioning system.

An alternative embodiment of a belt tensioning system 200, in accordance with the present invention, in FIG. 4, includes a flexible photoreceptor belt 10 in a tensioned image receiving position entrained around drive roll 16, steering roll 20 and stripping roll 14. Multiple backer bars 23 are stationary and serve to position and guide flexible photoreceptor belt 10 in a predetermined closed loop path. A controller 29 through clock 24 and conventional means, such as, a stepper motor (not shown) controls rotation of cam 210 which in turn tensions and de-tensions flexible photoreceptor belt 10. When copies are required, an operator actuates controller 29, which then rotates cam 210 in a clockwise direction to tension flexible photoreceptor belt 10 into an image receiving position. Once the requirement for copies has been completed, the printer goes into a standby, energy saving mode and cam 210 is rotated in a counter clockwise direction in order to de-tension photoreceptor belt 10 to thereby reduce fatigue of photoreceptor belt 10.

Another alternative photoreceptor belt de-tensioning approach could be achieved by direct replacement of the rotation cam 160 in FIG. 2 with the de-tensioning system described in FIG. 4 for the belt support module application shown in FIG. 2.

The invention will now be described in detail with respect to specific preferred embodiments thereof, it being noted that these examples are intended to be illustrative only and are not intended to limit the scope of the present invention.

EXAMPLE I

An electrophotographic imaging member was prepared by providing a 0.01 micrometer thick titanium layer coated on a polyester substrate (PET) (Melinex 442, available from ICI Americas, Inc.) having a thickness of 3 mils (76.2 micrometers) and applying thereto, using a ½ mil gap Bird applicator, a solution containing 10 grams gamma aminopropyltriethoxy silane, 10.1 grams distilled water, 3 grams acetic acid, 684.8 grams of 200 proof denatured alcohol and 200 grams heptane. This layer was then allowed to dry for 5 minutes at 135° C. in a forced air oven. The resulting blocking layer had an average dry thickness of 0.05 micrometer measured with an ellipsometer.

An adhesive interface layer was then prepared by applying with a ½ mil gap Bird applicator to the blocking layer a wet coating containing 5 percent by weight based on the total weight of the solution of polyester adhesive (Mor-Ester 49,000, available from Morton International, Inc.) in a 70:30 volume ratio mixture of tetrahydrofuran/cyclohexanone. The adhesive interface layer was allowed to dry for 5 minutes at 135° C. in a forced air oven. The resulting adhesive interface layer had a dry thickness of 0.065 micrometer.

The adhesive interface layer was thereafter coated with a photogenerating layer containing 7.5 percent by volume trigonal selenium, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 grams polyvinyl carbazole and 140 mls of a 1:1 volume ratio of a mixture of tetrahydrofuran and toluene into a 20 oz. amber bottle. To this solution was added 8 grams of trigonal selenium and 1,000 grams of ⅛ inch (3.2 millimeter) diameter stainless steel shot. This mixture was then placed on a ball mill for 72 to 96 hours. Subsequently, 50 grams of polyvinyl carbazole and 2.0 grams of N,N'-diphenyl-N,N'-bis(3-methylphenyl)-1,1'-biphenyl-4,4'-diamine were dissolved in 75 ml of 1:1 volume ratio of tetrahydrofuran/toluene. This slurry was then placed on a shaker for 10 minutes. The resulting slurry was thereafter applied to the adhesive interface layer by using a ½ mil gap Bird applicator to form a coating layer having a wet thickness of 0.5 mil (12.7 micrometers). However, a strip about 10 mm wide along one edge of the substrate bearing the blocking layer and the adhesive layer was deliberately left uncoated by any of the photogenerating layer material to facilitate adequate electrical contact by the ground strip layer that was applied later. This photogenerating layer was dried at 135° C. for 5 minutes in a forced air oven to form a dry photogenerating layer having a thickness of 2.0 micrometers.

This coated imaging member web was simultaneously overcoated with a charge transport layer and a ground strip layer using a 3 mil gap Bird applicator. The charge transport layer was prepared by introducing into an amber glass bottle a weight ratio of 1:1 N,N'-diphenyl-N,N'-bis(3-methylphenyl)-1,1'-biphenyl-4-4'-diamine and Makrolon 5705, a polycarbonate resin having a molecular weight of from about 50,000 to 100,000 commercially available from Farbenfabriken Bayer A. G. The resulting mixture was dissolved to give a 15 percent by weight solid in 85 percent by weight methylene chloride. This solution was applied onto the photogenerator layer to form a coating which upon drying had a thickness of 24 micrometers.

The approximately 10 mm wide strip of the adhesive layer left uncoated by the photogenerator layer was coated with a ground strip layer. This ground strip layer, after drying at 135° C. in a forced air oven for 5 minutes, had a dried thickness of about 14 micrometers. This ground strip is electrically grounded, by conventional means such as a carbon brush contact device during a conventional xerographic imaging process.

An anti-curl coating was prepared by combining 8.82 grams of polycarbonate resin of 4,4'-isopropylidene diphenol (Makrolon 5705, having a molecular weight of about 120,000 and available from Bayer AG), 0.08 gram of copolyester resin (Vitel PE-100, available from Goodyear Tire and Rubber Company) and 90.1 grams of methylene chloride in a glass container to form a coating solution containing 9 percent solids. The container was covered tightly and placed on a roll mill for about 24 hours until the polycarbonate and polyester were dissolved in the methylene chloride to form the anti-curl coating solution. The anti-curl coating solution was then applied to the rear surface (side opposite the photogenerator layer and charge transport layer) of the imaging member with a 3 mil gap Bird applicator and dried at 135° C. for about 5 minutes in a forced air oven to produce a dried film thickness of about 13.5 micrometers and containing approximately 1 weight percent Vital PE-100 adhesion promoter, based on the total weight of the dried anti-curl layer. The resulting electrophotographic imaging member was used for fatigue flexing mechanical cyclic test.

EXAMPLE II

The electrophotographic imaging members of Example I were cut to give two 2 inch by 12 inch imaging test samples for imaging member fatigue charge transport layer cracking determination. Testing was carried out by means of a dynamic mechanical cycling device in which three equally spaced ¾ inch diameter free-rotation rollers were positioned to provide each imaging test sample flexing that would simulate the dynamic fatigue condition of an imaging member belt as it would be functioning in a machine under service environment. More specifically, one end of the test sample was clamped to a stationary post at the base of the device and then the sample, with the charge transport layer facing outwardy, was looped upwardly over the three equally spaced horizontal rollers and over a one inch free-rotation idle guiding roller through a general inverted "U" shaped path with the free end of the test sample secured to a two pound weight in order to yield a one pound per inch width test sample tension.

Each free-rotation roller was secured at each end to an adjacent vertical surface of a pair of disks that were rotatable about a shaft connecting to the center of each disk. The equally spaced free-rotating rollers were parallel to each other and positioned equidistant from the shaft that connected the centers of the two disks. The distance between the axis of each free-rotating roller to the axis of the shaft was about 4 cm. Thus, when the disks rotated about the connecting shaft, two free-rotating rollers were maintained at all times in contact with the imaging test sample to cause a portion of the test imaging sample to flex over the contacting rollers. The direction of rotation the disk pair was toward the imaging test sample end that was clamped to the stationary post. Since there were three free-rotating rollers in the cycling device, each complete disk pair rotation would give three fatigue imaging test sample flexes. The rotation of the spinning disk pair was adjusted to provide the equivalent of 11.3 inches per second tangential speed and a maximum bending wrapped angle of about 1100°.

The first imaging test sample was fatigue cycling tested according to the procedures described above. The cycling was carried out non stop for each 8-hour work day, with pauses occurring only to examine the sample for charge transport layer cracking at each 1,000 rotation cycles interval under 100× magnification. The fatigue cycling test was suspended at the end of each workday and throughout two-day weekends with the imaging test sample under constant tension. The onset of fatigue charge transport layer cracking was noted after about 102,000 imaging sample flexes.

The second imaging test sample was also cycling tested in the same manners as the first imaging test sample, with the exception that the imaging test sample tension was removed whenever dynamic fatigue cycling was stopped after each 8 hour-day and throughout each weekend. The onset of charge transport layer cracking was not evident until after about 163,000 imaging test sample flexes indicating that suppression of imaging sample creep compliance by removal of imaging sample tension during idling periods could significantly extend the fatigue cracking cycles of the imaging sample. The result obtained by following the present invention approach represents about 1.6× service life improvement.

Although the above mentioned experiment showed that the charge transport layer cracking life enhancement was effectual by total elimination of imaging sample tension, nonetheless partial imaging sample de-tensioning to between 0.05 and 0.5 pound per inch imaging sample width tension is also within the scope of the present invention.

It should now be apparent that a flexible photoreceptor de-tensioning approach has been disclosed which is found to effect the increase in flexible photoreceptor charge transport layer cracking life. Furthermore, alternative theoretical analysis carried out for a machine utilizing a specific belt support module design has also shown that the extension of photoreceptor belt life by more than a factor of 2 may be realized, if the cumulative photoreceptor belt charge transport layer strain due to belt creep contribution is significantly suppressed by loosening the photoreceptor belt during machine off time.

While the invention has been described with reference to the structure herein disclosed, it is not confined to the details as set forth and is intended to cover any modifications and changes that may come within the scope of the following claims.

What is claimed is:

1. A method for increasing the number of defect free cycles of a charge receptive belt in a copier/printer, comprising the steps of:

providing a charge receptive belt;

tensioning the charge receptive belt during use thereof; and de-tensioning partially the charge receptive belt at a predetermined belt idling time.

2. The method of claim 1, wherein said partial de-tensioning of said charge receptive belt is between about 0.05 and about 0.5 pound per inch width belt tension.

3. The method of claim 1, wherein said predetermined belt idling time is when the copier/printer is in a standby or energy saver mode.

4. The method of claim 1, wherein said predetermined belt idling time is when the copier/printer is at the end of a workday or other non-work days.

5. The method of claim 2, including the step of providing a photoreceptor as said charge receptive belt.

6. The method of claim 5, including the step of providing a flexible photoreceptor as said charge receptive belt.

7. The method of claim 1, wherein said predetermine belt idling time is when the copier/printer is not in use.

8. A method for increasing photoreceptor belt life in a copier/printer, comprising the steps of:

providing photoreceptor belt support structure including a drive roll, a stripper roll, a steering roll, a plurality of idler rolls and a series of backer bars;

mounting a flexible photoreceptor belt on said photoreceptor belt support structure;

tensioning said photoreceptor belt; and de-tensioning partially said photoreceptor belt at predetermined belt idling times when the copier/printer is not in use.

9. The method of claim 8, wherein said de-tensioning of said flexible photoreceptor belt is between about 0.05 and about 0.5 pound per inch width belt tension.

10. The method of claim 8, wherein said predetermined belt idling times are when the copier/printer is in an energy saver mode.

11. The method of claim 8, wherein said predetermined belt idling times include when the copier/printer is not in use.

12. The method of claim 8, wherein said predetermined belt idling times include the end of workdays and weekends.

* * * * *